US009879458B2

(12) United States Patent
Gabriel et al.

(10) Patent No.: US 9,879,458 B2
(45) Date of Patent: Jan. 30, 2018

(54) EASILY DISPLACEABLE SLIDING DOOR

(71) Applicants: Stefano Gabriel, Treviso (IT); Piergiorgio Polloni, Treviso (IT)

(72) Inventors: Stefano Gabriel, Treviso (IT); Piergiorgio Polloni, Treviso (IT)

( * ) Notice: Subject to any disclaimer, the term of this patent is extended or adjusted under 35 U.S.C. 154(b) by 132 days.

(21) Appl. No.: 14/604,716

(22) Filed: Jan. 24, 2015

(65) Prior Publication Data

US 2015/0211276 A1 Jul. 30, 2015

(30) Foreign Application Priority Data

Jan. 27, 2014 (IT) ..... VI2014A000019

(51) Int. Cl.
*E05D 15/06* (2006.01)
*E05D 13/00* (2006.01)

(52) U.S. Cl.
CPC ..... *E05D 15/063* (2013.01); *E05D 13/00* (2013.01); *E05D 15/0621* (2013.01); *E05D 15/0652* (2013.01); *E05D 2015/0695* (2013.01); *E05Y 2201/46* (2013.01); *E05Y 2201/64* (2013.01); *E05Y 2600/60* (2013.01); *E05Y 2800/352* (2013.01); *E05Y 2900/142* (2013.01)

(58) Field of Classification Search
CPC ..... E05D 15/0626; E05D 15/063; E05D 15/0621; E05D 2015/0695; E04B 2/7416
See application file for complete search history.

(56) References Cited

U.S. PATENT DOCUMENTS 4,698,876 A * 10/1987 Karita ..... E05D 15/06 16/102
7,013,605 B2 * 3/2006 Zhou ..... E05F 15/60 187/315
8,132,653 B2 * 3/2012 Flynn ..... B66B 13/08 187/313
8,196,353 B2 * 6/2012 Loidolt ..... E05D 15/0617 49/404
8,479,447 B2 * 7/2013 Liebscher ..... E05F 15/635 49/360

(Continued)

FOREIGN PATENT DOCUMENTS

DE 102004050340 A1 4/2006
EP 1647657 A2 4/2006

(Continued)

*Primary Examiner* — Katherine W Mitchell
*Assistant Examiner* — Catherine A Kelly
(74) *Attorney, Agent, or Firm* — Themis Law

(57) ABSTRACT

An easily displaceable sliding door configured to be installed in an opening of a partition wall includes a shutter having an upper edge, a carriage secured to the shutter at the upper edge, a guiding member configured to be secured to the opening substantially parallel to the upper edge to allow sliding of the carriage, a magnetic unit having a lower portion integral with the shutter and an upper portion configured to be secured to the guiding member to reduce the weight force of the shutter to facilitate displacement, wherein the upper and a lower portions are separated by an air gap. The guiding member is of linear type and includes a straight cavity with an upper wall for supporting the upper portion of the magnetic unit, the upper edge and the a carriage being entirely embedded in the cavity to be hidden from external view.

10 Claims, 6 Drawing Sheets

(56) References Cited

U.S. PATENT DOCUMENTS

| | | | | |
|---|---|---|---|---|
| 2003/0221374 | A9* | 12/2003 | Zhou | E05F 15/60 52/30 |
| 2008/0202860 | A1* | 8/2008 | Flynn | B66B 13/08 187/316 |
| 2014/0016885 | A1* | 1/2014 | Rainis | E05D 15/06 384/8 |
| 2014/0041304 | A1* | 2/2014 | Martin | E05D 15/0626 49/352 |
| 2014/0338845 | A1* | 11/2014 | Ebeling | E05D 15/0621 160/214 |

FOREIGN PATENT DOCUMENTS

| | | | |
|---|---|---|---|
| JP | H06101379 | | 4/1994 |
| WO | WO2011016114 | A1 | 2/2011 |

* cited by examiner

EASILY DISPLACEABLE SLIDING DOOR

FIELD OF THE INVENTION

The present invention generally finds application in the field of civil or industrial building and sliding doors and windows, and particularly relates to an easily displaceable sliding door.

BACKGROUND OF THE INVENTION

Sliding doors are known, which comprise a load-bearing frame connected to a masonry or partition wall of a building and adapted to support a sliding door shutter between a closed position and an open position.

Sliding doors also typically include a sliding support system for supporting the shutter, which comprises one or more carriages fixed to the upper and/or lower edges of the shutter, each equipped with one or more pairs of wheels sliding within a guide associated with the load-bearing frame.

The shutter may be opened/closed by simply acting thereupon with a sufficient force to cause the carriages to slide along the guide Nevertheless, if large shutters are used, the user will be required to exert a very large force to promote movement thereof.

This may cause difficulties in using the door by particular classes of people such as children, the elderly or the handicapped.

Furthermore, the difficulty in opening/closing large sliding doors may be a risk in emergencies.

In order to ensure both easy access by any kind of user and safety, the force that the user is required to apply on the shutter to promote sliding thereof shall not exceed a predetermined value, which is established by applicable standards.

Therefore, sliding doors are known which comprise shutter supporting systems adapted to relieve the weight thereof and reduce the effort required of the user below such reference values.

U.S. Pat. No. 7,752,810 discloses a sliding door supporting device which comprises a guide fixed to the upper edge of the frame, for slidingly receiving a carriage that is adapted to support a door shutter by appropriate connection means.

The carriage comprises a pair of wheels sliding on the guide and an upper wall for supporting a plurality of first magnets having the same magnetic polarity. The guide has a seat for housing a plurality of second magnets in facing relationship to the first magnets and with opposite polarity.

The first magnets integral with the carriage and the second magnets integral with the guide have an air gap therebetween with the flux lines of the magnetic field passing therethrough to exert an upward attractive force on the carriage and counteract the weight force of the sliding shutter.

A first drawback of this known arrangement is that the carriage has a great thickness and the edge of the door shutter connected thereto projects out of the guide, whereby the system is very bulky.

Furthermore, the great distance between the carriage and the shutter edge facilitates horizontal oscillations of the shutter in response to the force applied by the user, which will reduce slidability of the shutter as it is being opened or closed.

The considerable bulk of the support system complicates installation in an adequate mounting space, which makes the system unsuitable for small-size installation conditions.

A further drawback of this prior art system is that the fixation arrangement that secures the door shutter outside the guide is externally visible, and reduces aesthetic quality, by affecting visual cleanness of the door.

Another serious drawback of this arrangement is that the air gap between the first and second magnets is not easily adjusted, as its adjustment requires operation of screw means that are hardly reachable, as they are entirely embedded in the guide.

SUMMARY OF THE INVENTION

The main object of the present invention is to overcome the above drawbacks, by providing an easily displaceable sliding door that is highly efficient and relatively cost-effective.

A particular object of the present invention is to provide a sliding door that affords easy sliding of the shutter, regardless of its size.

A further object of the present invention is to provide an easily displaceable sliding door that has relatively small dimensions.

A further object of the present invention is to provide an easily displaceable sliding door that can be installed in large openings.

Yet another object of the present invention is to provide an easily displaceable sliding door that has a high aesthetic value, with a cleaner visual effect perceived by a viewer.

A particular object of the present invention is to provide an easily displaceable sliding door that allows easy adjustment of the position and inclination of the shutter even after installation of the door.

These and other objects, as better explained hereafter, are fulfilled by an easily displaceable sliding door as defined in claim 1, comprising a shutter with an upper edge, at least one carriage secured to said shutter at said upper edge, guide means, adapted to be secured to said opening and substantially parallel to said upper edge to allow sliding of said carriage, magnetic means comprising at least one lower portion integral with said shutter and at least one upper portion adapted to be secured to said guide means to reduce the weight force of said shutter for easy displacement thereof, wherein said upper portion and said lower portion are separated by an air gap.

The linear guide means comprise a straight cavity with an upper wall for supporting said upper portion of said magnetic means, said upper edge being completely embedded in said cavity to be hidden from external view.

With this arrangement even large sliding doors may be easily displaced and will have superior visual cleanness and relatively small dimensions.

Advantageous embodiments of the invention are defined in accordance with the dependent claims.

BRIEF DESCRIPTION OF THE DRAWINGS

Further characteristics and advantages of the invention will be more apparent upon reading of the detailed description of a few preferred, non-exclusive embodiments of an easily displaceable sliding door, which are described as a non-limiting example with the help of the annexed drawings, in which.

DETAILED DESCRIPTION OF EMBODIMENTS OF THE INVENTION

Figure 1:
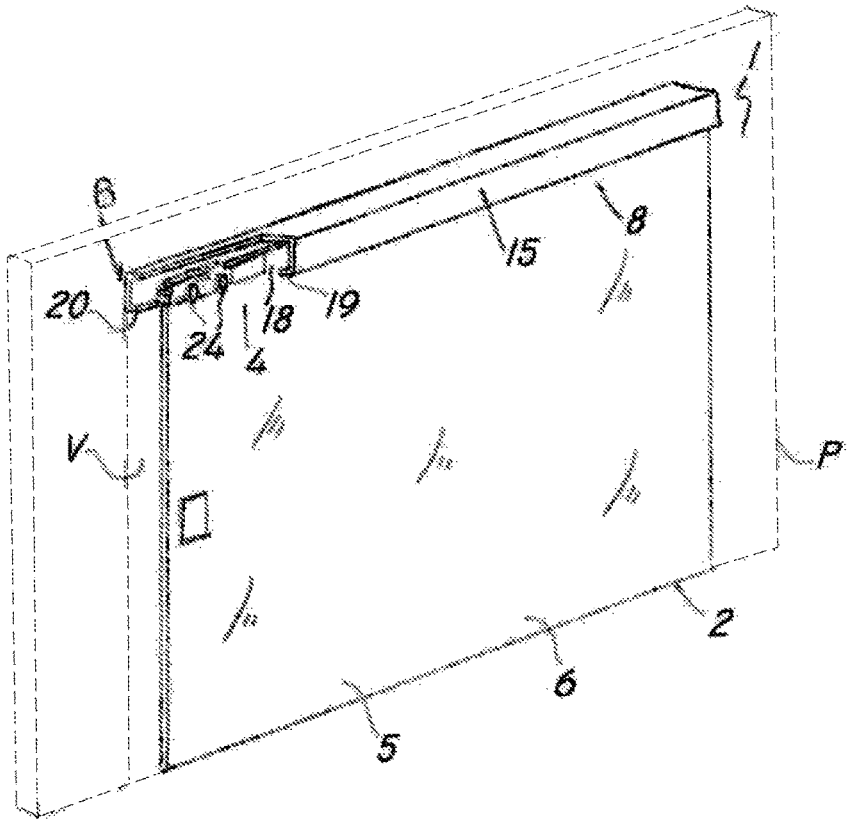
FIG. 1 shows a schematic and partially broken-away perspective view of an easily displaceable sliding door of the invention according to a first embodiment.

Particularly referring to FIG. 1, there is shown an easily displaceable sliding door of the invention, generally designated by numeral 1, which is designed for installation in a passage opening V formed in a partition wall P of a building.

Particularly, the sliding door 1 may be used to move between two adjacent spaces, generally intended for commercial or industrial use, but possibly also for residential use.

In its basic embodiment, the sliding door 1 of the invention comprises a shutter 2 having an upper edge 3 with at least one carriage 4 secured thereto.

The shutter 2 comprises a generally rectangular or square panel 5 made of glass, wood, plastic or any metal material, and has substantially flat opposite faces 6, 7.

Furthermore, the upper edge 3 of the shutter 2 is substantially straight and extends along a substantially horizontal axis L.

In a preferred, non-exclusive embodiment, the shutter 2 is composed of at least one pair of mutually facing glass sheets, with one or more layers of a sound-absorbing film interposed therebetween.

The upper edge B of the opening V has guide means 8 secured thereto, which are substantially parallel to the edge 3 and adapted to slideably receive the carriage 4.

Figure 2:
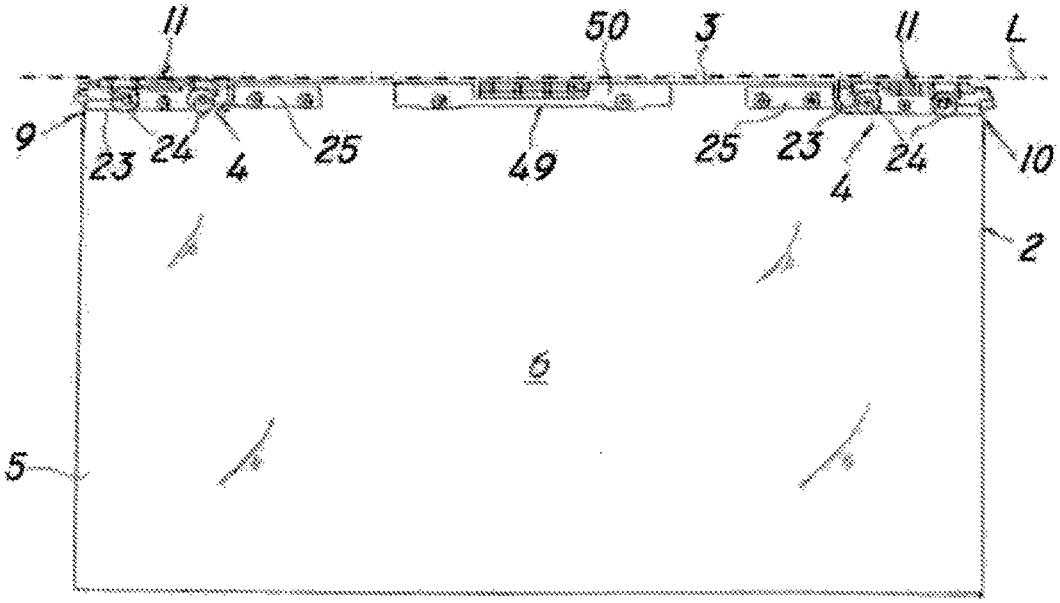
FIG. 2 is a side view of the sliding shutter of the door of FIG. 1.
Figure 3:
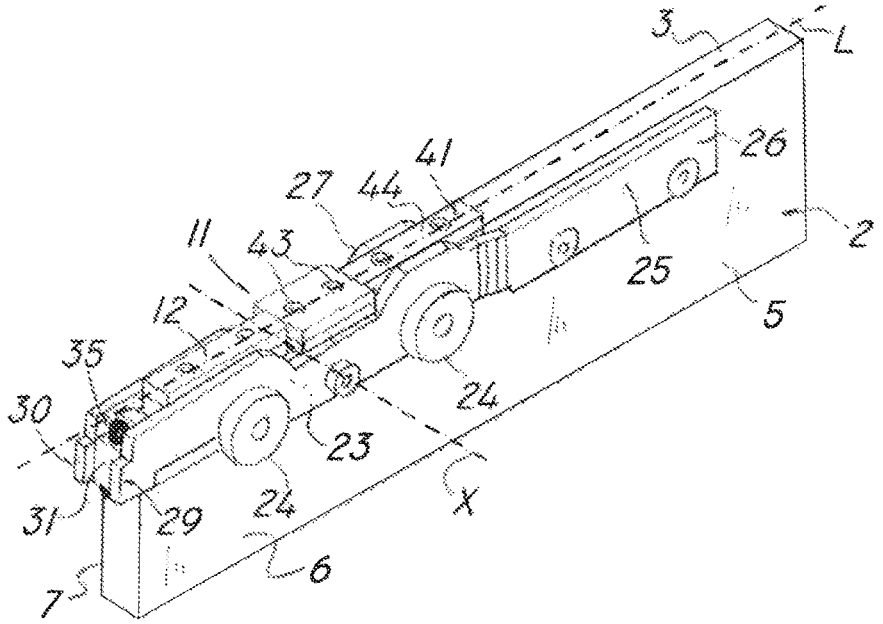
FIGS. 3 and 4 show assembled and exploded perspective views of a first detail of FIG. 1 respectively, according to a first embodiment.
Figure 4:
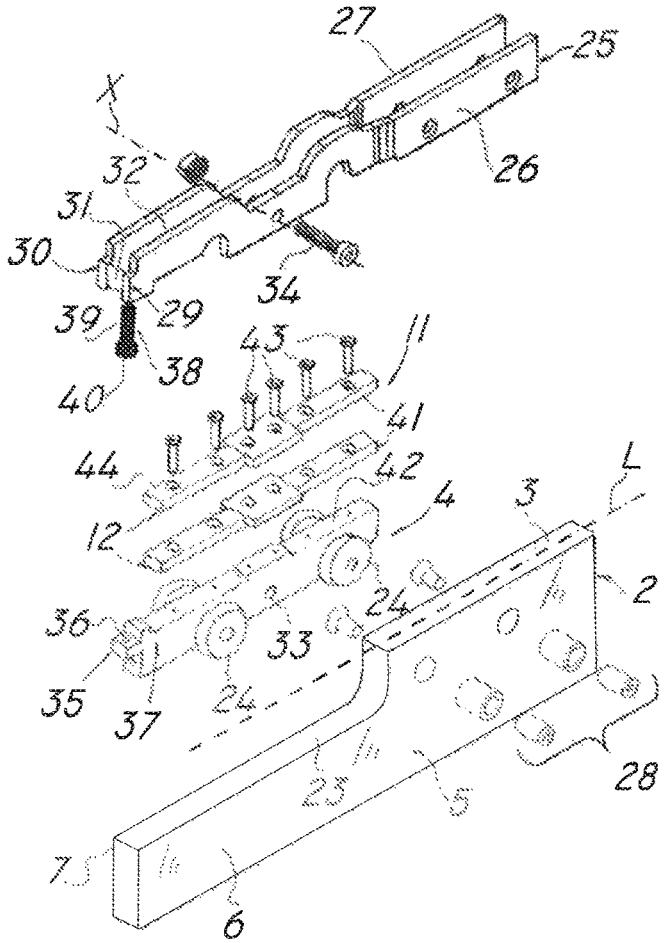
Figure 5:
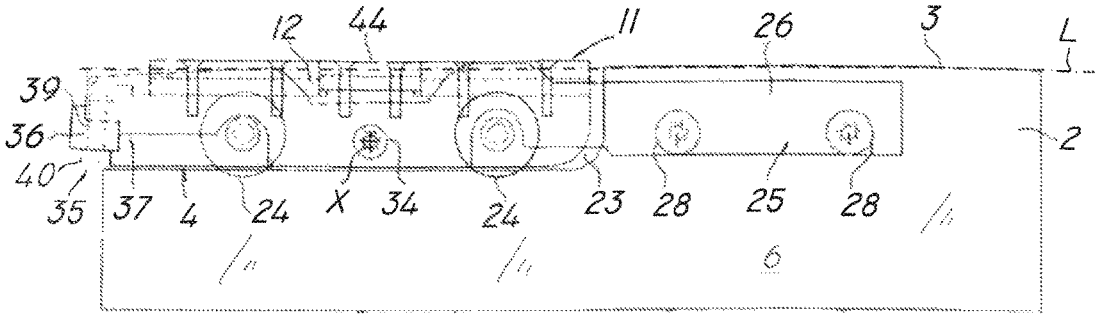
FIGS. 5 and 6 show side and top views of the first detail of FIG. 3 respectively.
Figure 6:
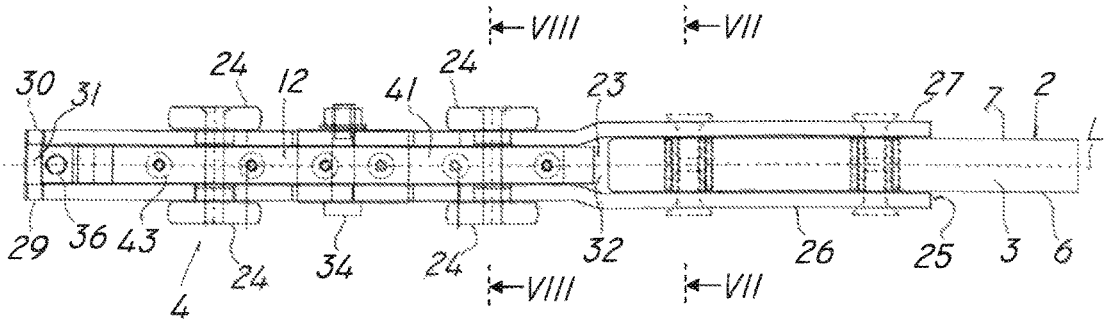
Figure 7:
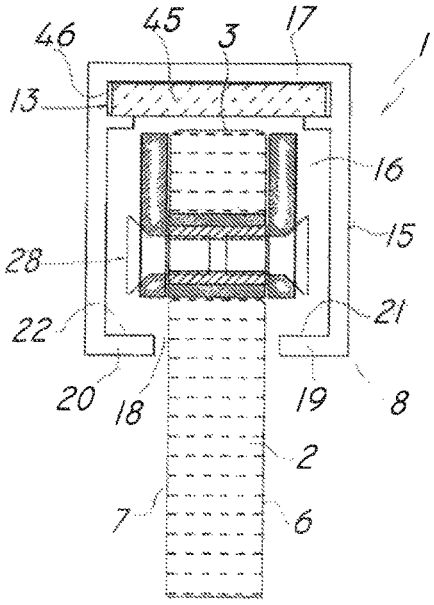
FIGS. 7 and 8 show partially broken-away views lateral views of the door of FIG. 1, with the first detail of FIG. 1 being shown in a sectional view as taken along planes VII-VII and VIII-VIII respectively.
Figure 8:
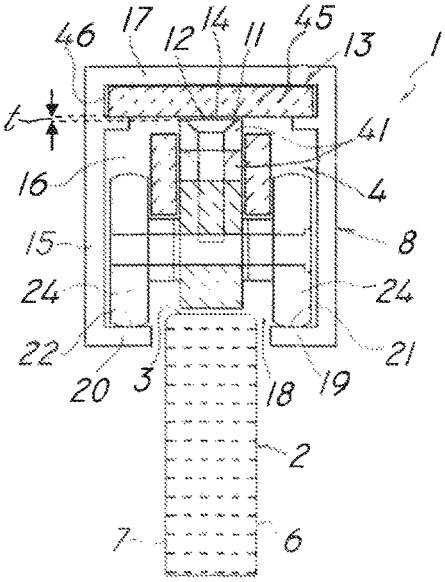

In the embodiment as shown in the figures, the sliding door 1 has a pair of carriages 4, secured to the shutter 2 proximate to its opposite longitudinal ends 9, 10, as clearly shown in FIG. 2, for improved centering of the carriages 4 and easier sliding thereof in the direction L.

Thus, the carriages 4 may slide along the guide means 8 between two end positions corresponding to the fully open position and the fully closed position of the shutter 2 respectively.

Magnetic means 11 are provided, which have a lower portion 12 integral with the shutter 2 and an upper portion 13 adapted to be secured to the guide means 8, and are suitably positioned in mutually interacting relationship to exert an upward magnetic force on the shutter 2, and counteract its weight force for easier displacement thereof along the guide means 8.

Conveniently, the lower portion 12 and the upper portion 13 of the magnetic means 11 are relatively close to each other and separated by an air gap 14 having a predetermined size t, e.g. a few tenths of a millimeter.

Conveniently, the air gap 14 may have a substantially constant size t throughout the longitudinal extent of the guide means 8.

Advantageously, the guide means 8 may be of linear type and comprise, for instance, a metal section 15 made of aluminum or steel, with a straight longitudinal cavity 16 having an upper wall 17 for supporting the upper portion 13 of the magnetic means 11, e.g. by adhesive bonding.

With this combination of features, even large and heavy shutters 2 of sliding doors 1 can be displaced in the longitudinal direction L with a reduced effort.

According to the invention, both the upper edge 3 of the shutter 2 and the carriages 4 are entirely embedded in the cavity 16 such that they are hidden from external view, thereby imparting high linearity and visual cleanness to the assembly, for enhanced aesthetic quality of the door 1.

Preferably, the section 15 may be a substantially U-shaped steel or aluminum extruded part, with a downwardly open longitudinal cavity forming a lower longitudinal opening 18 delimited by the longitudinal edges 19, 20 of the section 15 for the passage of the upper edge 3 of the shutter 2.

The longitudinal edges 19, 20 face inwards and their substantially horizontal upper faces 21, 22 define support and rolling surfaces for the carriages 4.

In a preferred embodiment, as best shown in FIGS. 2 to 12, the shutter 2 has a first seat 23 formed by a recessed or leveled portion of the opposite faces of the upper edge 3 for housing a corresponding carriage 4.

Particularly, a pair of first elongate seats 23 are formed at the longitudinal ends 9, 10 of the shutter 2, for housing the pair of carriages 4, which are mounted on wheels 24.

The wheels 24 of the carriages 4 may slide on the upper surfaces 21, 22 of the longitudinal edges 19, 20 of the guide means 8.

Figure 9:
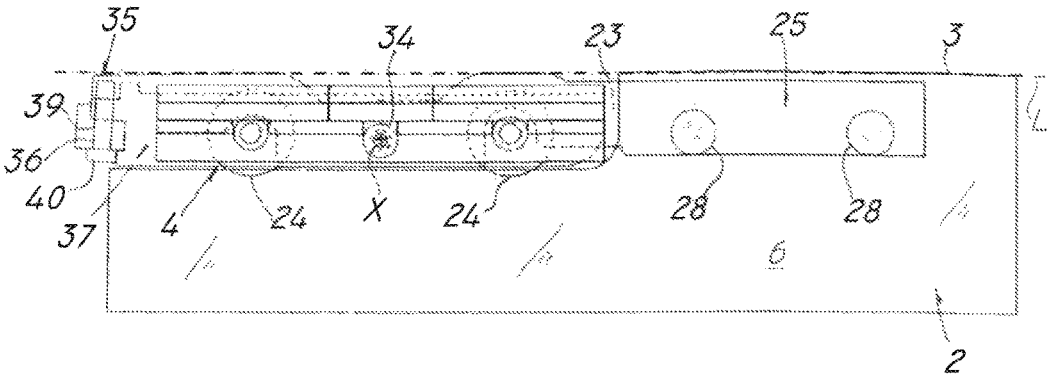
FIGS. 9 and 10 show side and top views of the first detail of FIG. 2 respectively, according to a second embodiment.
Figure 10:
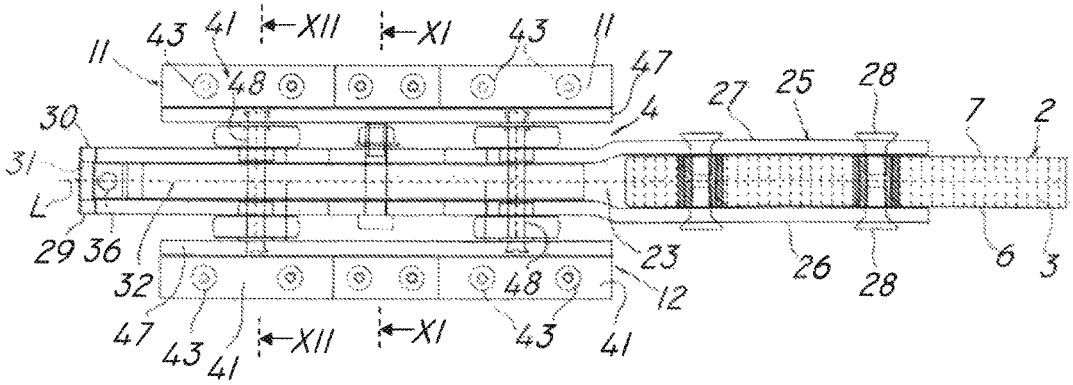

In a preferred embodiment, each carriage 4 may be secured to the shutter in the first seat 23 along the upper edge 2 by means of a first connecting bracket 25, as best shown in FIGS. 2 to 6 and in FIGS. 9 and 10, which is also adapted to be secured to the sliding shutter 2 proximate to its upper edge 3.

The first connecting bracket 25 may comprise a first pair of substantially parallel side walls 26, 27, which are located on the opposite faces 6, 7 of the shutter 2 and are connected thereto by respective screw connection members 28 or the like.

The side walls 26, 27 are joined together at their respective ends 29, 30 by a substantially transverse wall 31, to define a longitudinal space 32 designed to tightly receive the carriage 4.

As best shown in FIGS. 3, 4, 5 and 9, the carriage 4 may have a through transverse hole 33 extending along an axis X, which receives a pin 34 attached to the outer surfaces of the side walls 26, 27, for the carriage 4 to be able to oscillate relative to the first bracket 25 about the axis X.

Furthermore, adjustment means 35 are provided for adjusting the oscillation of the carriage 4 about the corresponding axis of oscillation X. The adjustment means 35 may comprise a threaded hole 36 formed at the end portion 37 of the carriage 4 that faces the transverse wall 31 of the first bracket 25.

A screw 38 with a threaded portion 39 is received in the hole 36 and has an enlarged head 40 which is designed to contact the edge 3 of the shutter 2 at the first seat 23.

By appropriately rotating the head 40 of the screw 38, the threaded portion 39 may be tightened to a given extent in the hole 36 formed in the carriage 4, thereby causing the latter to oscillate clockwise or counterclockwise about the axis of oscillation X.

The oscillation of the carriage 4 about its axis of oscillation X will adjust the position of the shutter 2 relative to the horizontal to prevent sticking thereof during displacement.

In a preferred embodiment, the lower portion 12 of the magnetic means 11 may comprise one or more substantially plate-like magnets 41 which are removably secured to the top surface 42 of the carriage 4.

The magnets 41 may comprise high-coercivity materials selected from the group of natural magnets, such as neodymium and other similar elements.

In the particular configuration of the invention as shown in the figures, the lower portions 12 of the magnetic means 11 comprise, for each carriage 4, a pair of plate-like magnets 41 lying on and removably secured to the top surface 42 of the carriage 4 by means of screws 43.

By appropriately changing the depth of the first seat 23 and the thickness of the cart 4, the position of the magnets 41 may be adjusted for the outer face 44 of the upper magnet 41 to be substantially flush with the upper edge 3 of the shutter 2.

Thus, the first seat 23 may be entirely embedded in the cavity 16 of the guide means 8, and the aesthetic quality of the assembly will be thus further improved.

Preferably, the upper portion 13 of the magnetic means 11 comprises a plate-like metal element 45 having a polygonal, e.g. substantially rectangular shape, which is removably placed within a housing 46 formed at the upper wall 17 of the guide means 8.

Furthermore, the plate-like metal element 45 may be selected from the group comprising diamagnetic materials, such as metal alloys or steel.

Conveniently, in the particular configuration of the sliding door 1 of FIGS. 3 to 8, a single plate-like element 45 will be provided, and a pair of plate-like magnets 41 will be provided for each carriage 4.

In a different configuration of the invention, as shown in FIGS. 9 to 12, the carriage 4 may comprise a pair of first support elements 47 located outside the side walls 26, 27 of the first bracket 25.

The lower portion 12 of the magnetic means 11 may comprise one or more pairs of permanent magnets 41 which are removably fixed to the first pair of support elements 47.

Figure 12:
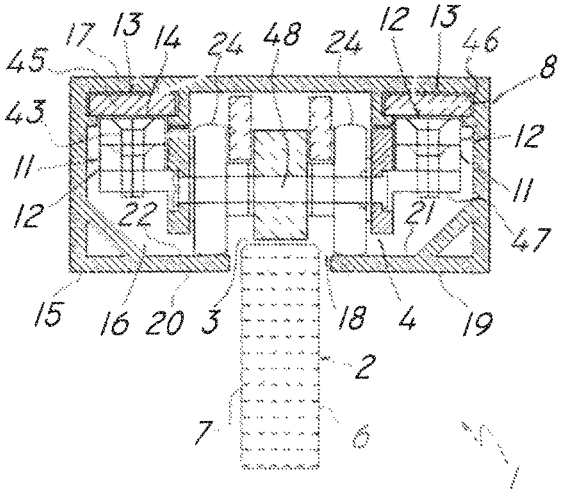

Preferably, as shown in FIGS. 10 and 12, the first support elements 47 may be stably connected to the carriage 4 at the hubs 48 of the wheels 24.

Figure 11:
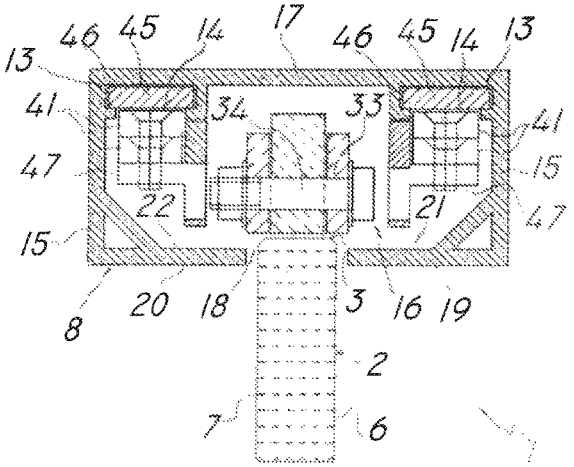
FIGS. 11 and 12 show a second embodiment of a sliding door of the invention with the first detail of FIG. 10 shown in a sectional view as taken along planes XI-XI and XII-XII respectively.

In this configuration, the guide means 8 may comprise a pair of housings 46, as best shown in FIGS. 11 and 12, which are formed at the upper wall 17 and are substantially aligned with the pair of lateral support elements 47 of the carriage 4.

Advantageously, the upper portion 13 of the magnetic means 11 may comprise a pair of plate-like elements 45 which are removably inserted in such housings 46.

This configuration of the invention is particularly suitable for relatively heavy sliding shutters 2, which require a high weight to be relieved by the generation of a considerable magnetic force.

For example, for a sliding door like the one of FIGS. 3 to 8, which comprises a rectangular shutter 2 having a height of about 3 m and a width of about 1 m and secured to a pair of carriages 4 mounted on wheels 24, it was experimentally found that the size t of the air gap 14 between the portions 12, 13 of the magnetic means 11 must not exceed 1 mm, and the optimal value t is particularly about 0.5 mm.

As compared with an identical door without the magnetic means 11, experimental tests have shown about 50% reduction of the force to be applied to the shutter 2 for displacement thereof.

Figure 13:
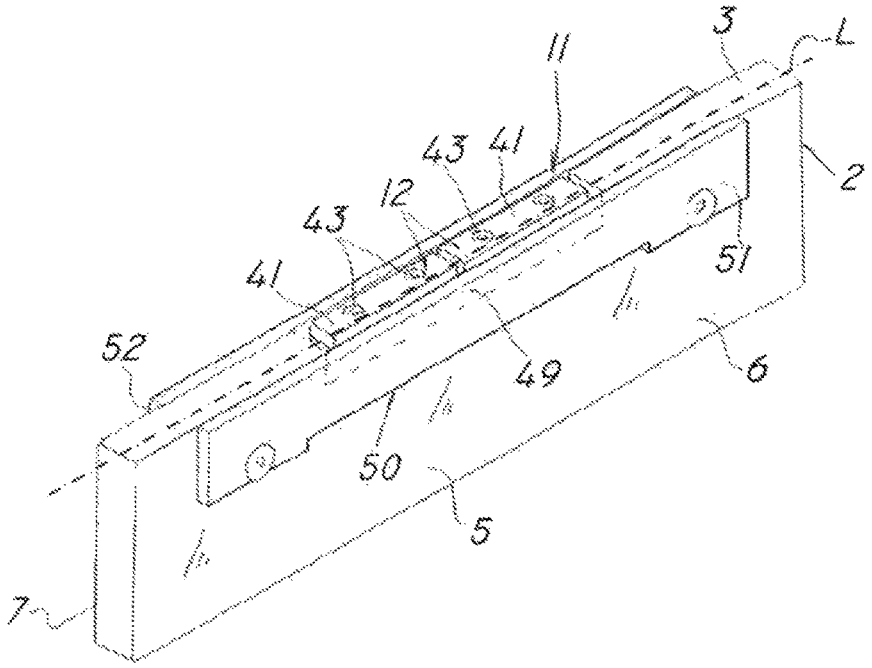
FIGS. 13 and 14 are assembled and exploded perspective views of a second detail of FIG. 2 respectively.
Figure 14:
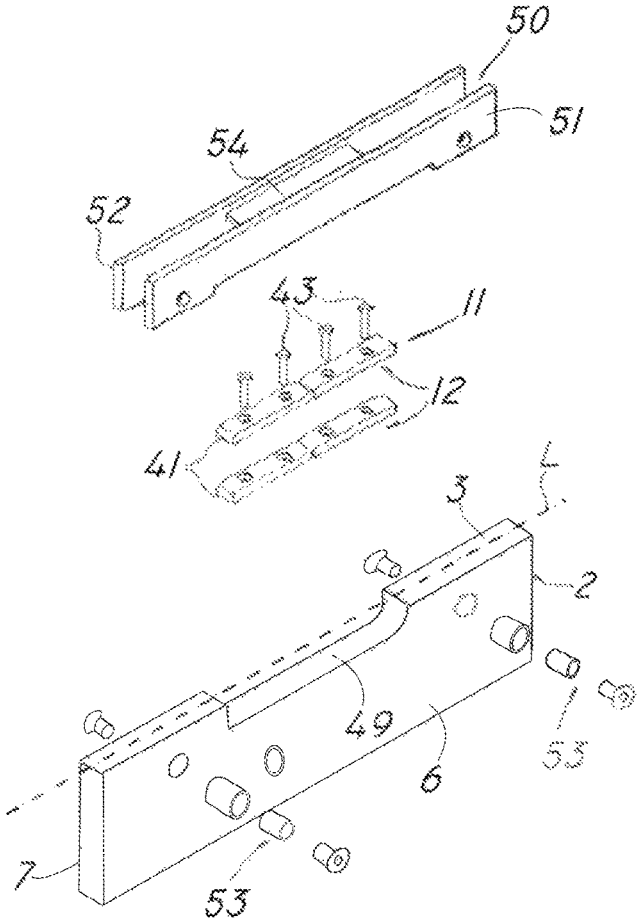

Conveniently, as best shown in FIGS. 13 and 14, the shutter 2 may have a second seat 49 formed at the upper edge 3 and adapted to accommodate a substantially straight second connecting bracket 50.

For example, the second connecting bracket 50 may comprise a second pair of substantially parallel side walls 51, 52, which can be located on the opposite faces 6, 7 of the shutter 2 and are connected thereto by second screw connection members or the like 53.

Furthermore, the second pair of side walls 51, 52 may be joined together by a substantially horizontal connecting wall 54 which is designed to removably support a lower portion 12 of the magnetic means 11.

The magnets 41 secured to the second bracket 50 may cooperate with the magnets 41 secured to the carriages 4 to increase the counteracting magnetic force generated by the magnetic means 11.

For this purpose, the number of second seats 49 formed in the shutter 2 may be selected according to the specific weight of the material that constitutes it, as well as according to its size.

Figure 15:
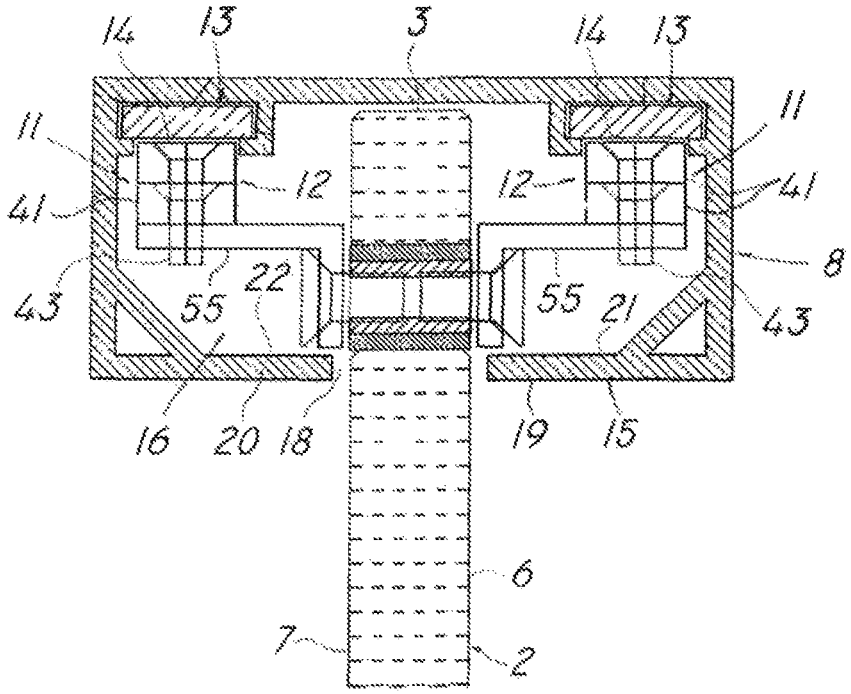
FIG. 15 is a broken-away partial view of the door of FIGS. 11 and 12, comprising the second detail of FIG. 14.

If the door 1 has a configuration as shown in FIGS. 9 to 12, then the second bracket 50 may have a pair of second lateral support elements 55, as shown in FIG. 15, which are located outside the second side walls 51, 52 and are adapted to removably support one or more lower portions 12 of said magnetic means 11.

Particularly, the second support elements 55 may allow removable accommodation of a plurality of magnets 41, which may be spaced from their respective plate-like metal element 45 by an air gap 14 having a size t.

In a further embodiment of the invention, not shown, means may be provided for adjusting the air gap 14, which are adapted to change the height of the lower portion 12 and/or the upper portion 13 to appropriately adjust the air gap 14 according to the weight force of the shutter 2.

The sliding door 1 of the invention is susceptible of a number of changes and variants, within the inventive principle disclosed in the appended claims.

All the details thereof may be replaced by other technically equivalent parts, and the materials may vary depending on different needs, without departure from the scope of the invention.

While the sliding door of the invention has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention finds industrial application in civil or industrial buildings, particularly in the fabrication of sliding doors and windows.

The invention claimed is:

1. A sliding door (1) designed to be mounted on an opening (V) of a partition wall (P), comprising:

a shutter (2) with an upper edge (3);

a carriage (4) anchored to said shutter (2) proximately of said upper edge (3);

a guiding member (8) securable to an upper edge of said opening (V) in substantially parallel relationship with respect to said upper edge (3) to allow sliding of said carriage (4); and a magnetic unit (11) comprising at least one lower portion (12) integral with said shutter (2) and at least one upper portion (13) secured to said guiding member (8) to reduce a weight of said shutter (2) to make easier a movement thereof via an attractive force between said at least one upper portion and said at least one lower portion, wherein said at least an upper (13) and a lower portion (12) are separated by an air gap (14), wherein said guiding member (8) is linear and comprises a straight cavity (16) with an upper wall (17) configured to support said at least one upper portion (13) of said magnetic unit (11), wherein said at least one lower portion (12) comprises one or more substantially flat magnets (41) removably fastened to an upper surface (42) of said carriage (4), wherein said at least one upper portion (13) of said magnetic unit (11) comprises a metal plate member (45) removably inserted into a housing (46) formed proximately to the upper wall (17) of said guiding member (8), said upper edge (3) and said carriage (4) being completely sunk into said cavity (16) such not to protrude therefrom, wherein said shutter (2) has a first seat (23) in proximity of said upper edge (3), said seat being defined by a recessed or leveled portion on opposite faces (6, 7) of an upper edge of said shutter, said seat housing said carriage (4), and wherein said carriage (4) has wheels (24) and is secured in said first seat (23) by a first connecting bracket (25) which is, in turn, anchored to said shutter (2) in proximity of said upper edge (3), and wherein said wheels roll on a portion of said guiding member inside said cavity.

2. The sliding door as claimed in claim 1, wherein said first connecting bracket (25) comprises a first pair of substantially parallel side walls (26, 27) located on and contacting opposite faces (6, 7) of said shutter (2) and connected thereto by a first fastener (28).

3. The sliding door as claimed in claim 2, wherein said carriage (4) is located between said first pair of side walls (26, 27) and is attached thereto to oscillate relative to said first bracket (25) around an oscillation axis (X) substantially perpendicular to said pair of side walls (26, 27).

4. The sliding door as claimed in claim 3, further comprising a device (35) for adjusting oscillation amplitude of said carriage (4) about said oscillation axis (X).

5. The sliding door as claimed in claim 2, wherein said carriage (4) comprises a pair of first supporting members (47) located outwardly of said side walls (26, 27), said at least one lower portion (12) of said magnetic unit (11) comprising one or more pairs of magnets (41) removably fixed on said pair of first supporting members (47).

6. The sliding door as claimed in claim 5, wherein said guiding member (8) comprises a pair of housings (46) formed in proximity of said upper wall (17) and substantially aligned to said pair of first side supporting members (47), and wherein said metal plate member comprises a pair of metal plates removably inserted into said pair of housings (46).

7. The sliding door as claimed in claim 1, wherein each of said magnets (41) contains neodymium.

8. The sliding door as claimed in claim 3, wherein said shutter (2) has a second seat (49) in proximity of said upper edge (3) for housing a second substantially straight connecting bracket (50) for attachment of a portion (12) of said magnetic unit (11).

9. The sliding door as claimed in claim 8, wherein said second bracket (50) has a second pair of parallel side walls (51, 52) placed on opposite faces (6, 7) of said shutter (2) and connected thereto by a second fastener (53), said second pair of side walls (51, 52) being joined by a substantially horizontal connecting wall (54) designed to support said at least one or more lower portions (12) of said magnetic unit (11).

10. The sliding door as claimed in claim 9, wherein said second bracket (50) comprises a pair of supporting members (55) placed outwardly of said second pair of side walls (51, 52) for removably supporting one or more lower portions (12) of said magnetic unit (11).

* * * * *